US008746526B2

(12) United States Patent
Hlinka et al.

(10) Patent No.: US 8,746,526 B2
(45) Date of Patent: Jun. 10, 2014

(54) FASTENER DRIVER WITH BLANK FIRE LOCKOUT

(75) Inventors: Eric Hlinka, Roselle, IL (US); Chia Sheng Liang, Taipei (TW); Chu Hsiang Tseng, Taipei County (TW); Chin Lung Chang, Taoyuan County (TW)

(73) Assignee: Robert Bosch GmbH, Stuttgart (DE)

( * ) Notice: Subject to any disclaimer, the term of this patent is extended or adjusted under 35 U.S.C. 154(b) by 732 days.

(21) Appl. No.: 12/559,724

(22) Filed: Sep. 15, 2009

(65) Prior Publication Data

US 2011/0062207 A1 Mar. 17, 2011

(51) Int. Cl.
*B21J 15/28* (2006.01)
*B27F 7/17* (2006.01)

(52) U.S. Cl.
USPC ..... 227/8

(58) Field of Classification Search
CPC .... B25C 1/008; B25C 1/005; B25B 23/0064; B25B 21/00
USPC ..... 227/8, 47, 129, 156, 120; 173/1–2, 201, 173/46–49, 216–217
See application file for complete search history.

(56) References Cited

U.S. PATENT DOCUMENTS 3,056,965 A * 10/1962 Rogers ..... 227/8
3,858,781 A 1/1975 Obergfell et al.
4,129,240 A * 12/1978 Geist ..... 227/8
4,197,974 A 4/1980 Morton et al.
4,289,095 A * 9/1981 Scherr ..... 123/142.5 R
4,323,127 A * 4/1982 Cunningham ..... 173/53
4,448,338 A * 5/1984 Graf et al. ..... 227/8
4,573,621 A * 3/1986 Merkator et al. ..... 227/8
4,597,517 A 7/1986 Wagdy
4,606,487 A * 8/1986 Douri ..... 227/8
4,762,035 A * 8/1988 Fushiya et al. ..... 81/429
5,020,712 A * 6/1991 Monacelli ..... 227/8
5,180,091 A 1/1993 Ota
5,263,626 A * 11/1993 Howard et al. ..... 227/8
5,385,286 A * 1/1995 Johnson, Jr. ..... 227/8
5,593,079 A 1/1997 Mukoyama et al.
5,683,024 A * 11/1997 Eminger et al. ..... 227/8
5,816,468 A 10/1998 Yang
6,012,622 A 1/2000 Weinger et al.
6,056,181 A 5/2000 Chuang
6,145,724 A 11/2000 Shkolnikov et al.
6,170,729 B1 * 1/2001 Lin ..... 227/8
6,176,412 B1 1/2001 Weinger et al.
6,179,192 B1 * 1/2001 Weinger et al. ..... 227/8
6,209,770 B1 * 4/2001 Perra ..... 227/8
6,267,284 B1 7/2001 Clark
6,427,896 B1 * 8/2002 Ho et al. ..... 227/142
6,592,014 B2 7/2003 Smolinski
6,609,646 B2 8/2003 Miller et al.

(Continued)

*Primary Examiner* — Robert Long
(74) *Attorney, Agent, or Firm* — Maginot, Moore & Beck

(57) ABSTRACT

A fastener driver comprises a housing and a magazine configured to retain a plurality of fasteners. A driver assembly is positioned within the housing and is configured to provide an expulsion force that expels one of the plurality of fasteners from the magazine. The device further includes a lockout member configured to pivot about a pivot axis between an unlocked position and a lockout position. The pivot axis is configured to move relative to the housing when a work contact element is depressed. The driver assembly is prevented from providing the expulsion force when the lockout arm is in the lockout position. The pivot arm moves from the unlocked position to the lockout position when a low level of fasteners remains in the magazine.

18 Claims, 9 Drawing Sheets

(56) References Cited

U.S. PATENT DOCUMENTS

| | | | | |
|---|---|---|---|---|
| 6,761,299 | B2 | 7/2004 | Caringella et al. | |
| 6,966,476 | B2 * | 11/2005 | Jalbert et al. | 227/8 |
| 7,000,294 | B2 | 2/2006 | Kakuda et al. | |
| 7,021,511 | B2 | 4/2006 | Popovich et al. | |
| 7,059,507 | B2 | 6/2006 | Almeras et al. | |
| 7,134,586 | B2 | 11/2006 | McGee et al. | |
| 7,140,524 | B2 * | 11/2006 | Hung et al. | 227/8 |
| 7,213,732 | B2 * | 5/2007 | Schell et al. | 227/8 |
| 7,225,962 | B2 * | 6/2007 | Porth et al. | 227/136 |
| 7,318,546 | B2 * | 1/2008 | Segura et al. | 227/142 |
| 7,328,826 | B2 | 2/2008 | Shkolnikov | |
| 7,341,172 | B2 * | 3/2008 | Moore et al. | 227/8 |
| 7,383,974 | B2 * | 6/2008 | Moeller et al. | 227/8 |
| 7,506,787 | B2 * | 3/2009 | Wu et al. | 227/8 |
| 7,677,281 | B2 * | 3/2010 | Baker et al. | 144/136.95 |
| 7,677,425 | B2 * | 3/2010 | Brendel et al. | 227/8 |
| 7,753,243 | B2 * | 7/2010 | Brendel et al. | 227/8 |
| 7,810,688 | B2 * | 10/2010 | Wu et al. | 227/8 |
| 7,845,530 | B2 * | 12/2010 | Schell et al. | 227/8 |
| 7,914,005 | B2 * | 3/2011 | Blessing et al. | 227/8 |
| 8,146,788 | B2 * | 4/2012 | Hlinka et al. | 227/8 |
| 8,336,748 | B2 * | 12/2012 | Hlinka et al. | 227/8 |
| 2003/0121948 | A1 | 7/2003 | Hsien | |
| 2005/0001007 | A1 * | 1/2005 | Butzen et al. | 227/130 |
| 2007/0057006 | A1 * | 3/2007 | Moore et al. | 227/8 |
| 2007/0090149 | A1 * | 4/2007 | Segura et al. | 227/142 |
| 2008/0164295 | A1 | 7/2008 | Wu et al. | |
| 2009/0020583 | A1 | 1/2009 | Kestner et al. | |
| 2009/0165892 | A1 * | 7/2009 | Baker et al. | 144/153 |
| 2010/0237125 | A1 * | 9/2010 | Jang | 227/8 |
| 2010/0327037 | A1 * | 12/2010 | Zhang et al. | 227/8 |
| 2011/0057014 | A1 * | 3/2011 | Yang et al. | 227/8 |
| 2011/0062207 | A1 * | 3/2011 | Hlinka et al. | 227/8 |
| 2011/0062208 | A1 * | 3/2011 | Hlinka et al. | 227/8 |
| 2011/0132958 | A1 * | 6/2011 | Hlinka et al. | 227/8 |

* cited by examiner

FASTENER DRIVER WITH BLANK FIRE LOCKOUT

FIELD

This invention relates to the field of power tools and particularly to devices used to drive fasteners into work-pieces.

BACKGROUND

Fasteners such as nails and staples are commonly used in projects ranging from crafts to building construction. While manually driving such fasteners into a work piece is effective, a user may quickly become fatigued when involved in projects requiring a large number of fasteners and/or large fasteners to be driven into a work piece. Moreover, proper driving of larger fasteners into a work piece frequently requires more than a single impact from a manual tool.

In response to the shortcomings of manual driving tools, power-assisted devices for driving fasteners into work pieces have been developed. Contractors and homeowners commonly use such devices for driving fasteners ranging from brad nails used in small projects to common nails which are used in framing and other construction projects. Compressed air has been traditionally used to provide power for the power-assisted (pneumatic) devices. However, other power sources have also been used, such as DC motors.

Various safety features have been incorporated into pneumatic and other power nailers. One such device is commonly referred to as a work contact element (WCE). A WCE is incorporated into nail gun designs to prevent unintentional firing of the nail gun. A WCE is typically a spring loaded mechanism which extends forwardly of the portion of the nail gun from which a nail is driven. In operation, the WCE is pressed against a work piece into which a nail is to be driven. As the WCE is pressed against the work piece, the WCE compresses the spring and generates an axial movement which is transmitted to a trigger assembly. The axial movement is used to reconfigure a safety device, also referred to as a trigger disabling mechanism, so as to enable initiation of a firing sequence with the trigger of the nail gun.

While the use of a WCE is very effective in preventing inadvertent firing of a nail gun, the location of the WCE can be problematic. Specifically, the WCE blocks the view that an operator has of the location on the work piece into which a nail or other fastener is to be driven. For projects which require fasteners to be driven into precise locations, the visual interference caused by the WCE can result in inaccurate placement of the fastener in the work piece.

Another safety device incorporated into power nailers is the blank fire lockout. The blank fire lockout prevents the nailer from firing when the magazine holding nails or other fasteners is empty or has only a few remaining fasteners. This feature is helpful since firing the device when no fasteners remain in the magazine may reduce the life of the tool and may prevent damage to the work piece which thus user must then repair. In past devices, the blank fire lockout mechanism includes a pivoting arm configured to block the path of the WCE when the magazine reaches a low level. The pivoting arm prevents the WCE from being depressed which, in turn, blocks the trigger from being depressed. Thus, the nailer cannot be fired when the fastener magazine is empty.

In past nailers incorporating blank fire lockout mechanisms, the nose of the nailer must be bulky and large in order to accommodate the interaction between the WCE arrangement and the blank fire lockout mechanism. This further blocks the view of the operator and reduces the maneuverability of the device.

What is needed is a safety system which can be used to prevent inadvertent nail gun firing while providing an operator with an unobstructed view of the location into which a fastener is to be driven. What is further needed is a blank fire lockout system configured for use with the WCE arrangement that allows for a reduced nose size and increases user visibility.

SUMMARY

In accordance with at least one embodiment of a fastener driver, there is provided a streamlined fastening device comprising a housing and a magazine configured to retain a plurality of fasteners. A driver assembly is positioned within the housing and is configured to provide an expulsion force that expels one of the plurality of fasteners from the magazine. The device further includes a lockout member configured to pivot about a pivot axis between an unlocked position and a lockout position. The pivot axis is configured to move relative to the housing. The driver assembly is prevented from providing the expulsion force when the lockout arm is in the lockout position. In at least one embodiment, the device further comprises a work contact element that extends from the housing and is moveable between an extended position and a depressed position. The driver assembly is prevented from delivering the expulsion force when the work contact element is in the extended position. Also, movement of the work contact element between the extended position and the depressed position results in movement of the pivot axis relative to the housing.

In accordance with at least one embodiment, a fastener driver comprises a magazine configured to retain a plurality of fasteners and a driver assembly configured to expel one of the plurality of fasteners from the magazine. A work contact element is configured to move between a first position and a second position. The driver assembly is allowed to expel fasteners when the work contact element is in the second position and prevented from expelling fasteners when the work contact element is in the first position. A lockout mechanism is coupled to the work contact element and configured to move with the work contact element when the work contact element is moved between the first position and the second position. The lockout mechanism is configured to move from an unlocked position to a locked position. The work contact element is prevented from moving to the second position when the lockout mechanism is in the locked position. In at least one embodiment, the lockout mechanism is configured to move from the unlocked position to the locked position based on the number and size of fasteners retained in the magazine.

In accordance with at least one embodiment of a fastener driver, there is provided a device comprising a nose configured to pass a fastener retained in a magazine. A work contact element extends from the nose. The work contact element is moveable between an extended position and a retracted position. A depth adjustment mechanism is coupled to the work contact element such that movement of the depth adjustment mechanism results in movement of the work contact element in the extended position. In addition, a lockout mechanism is coupled to the depth adjustment mechanism; the lockout mechanism is moveable between an unlocked position and a locked position. The lockout mechanism is configured to prevent movement of the work contact element from the extended position to the retracted position when the lockout mechanism is in the locked position. In at least one embodiment, rotational movement of the depth adjustment mechanism results in linear movement of the work contact element. Furthermore, the lockout mechanism is configured to move in a linear direction when the work contact element is moved from the extended position to the retracted position.

DESCRIPTION

Figure 1:
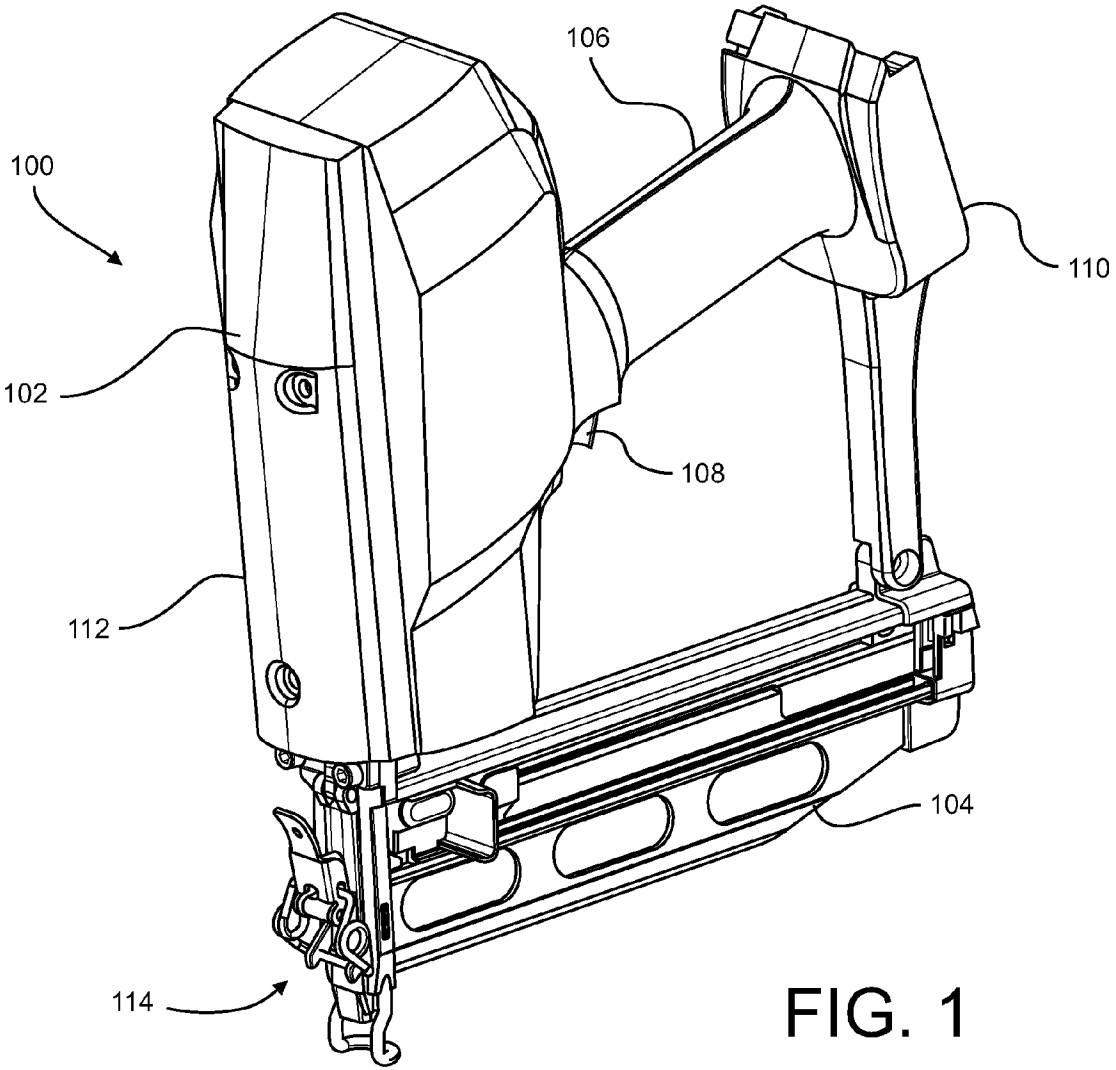
FIG. 1 depicts a side perspective view of an exemplary embodiment of a fastener driver with blank fire lockout.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

FIG. 1 depicts a device 100 for driving a fastener including a drive housing 102 and a fastener storage and feeding device 104. The term "magazine" as used herein refers to any such fastener storage and feeding device. The drive housing 102 defines a handle portion 106 from which a trigger 108 extends, a receptacle area 110 and a drive section 112. The fastener guide 104 in this embodiment is spring biased to force fasteners, such as nails or staples held in a cartridge or a clip, serially one after the other, into a loaded position adjacent the drive section 112. The receptacle area 110 may be used to connect a source of compressed air or other source of power (such as a battery) to the device 100.

Figure 2:
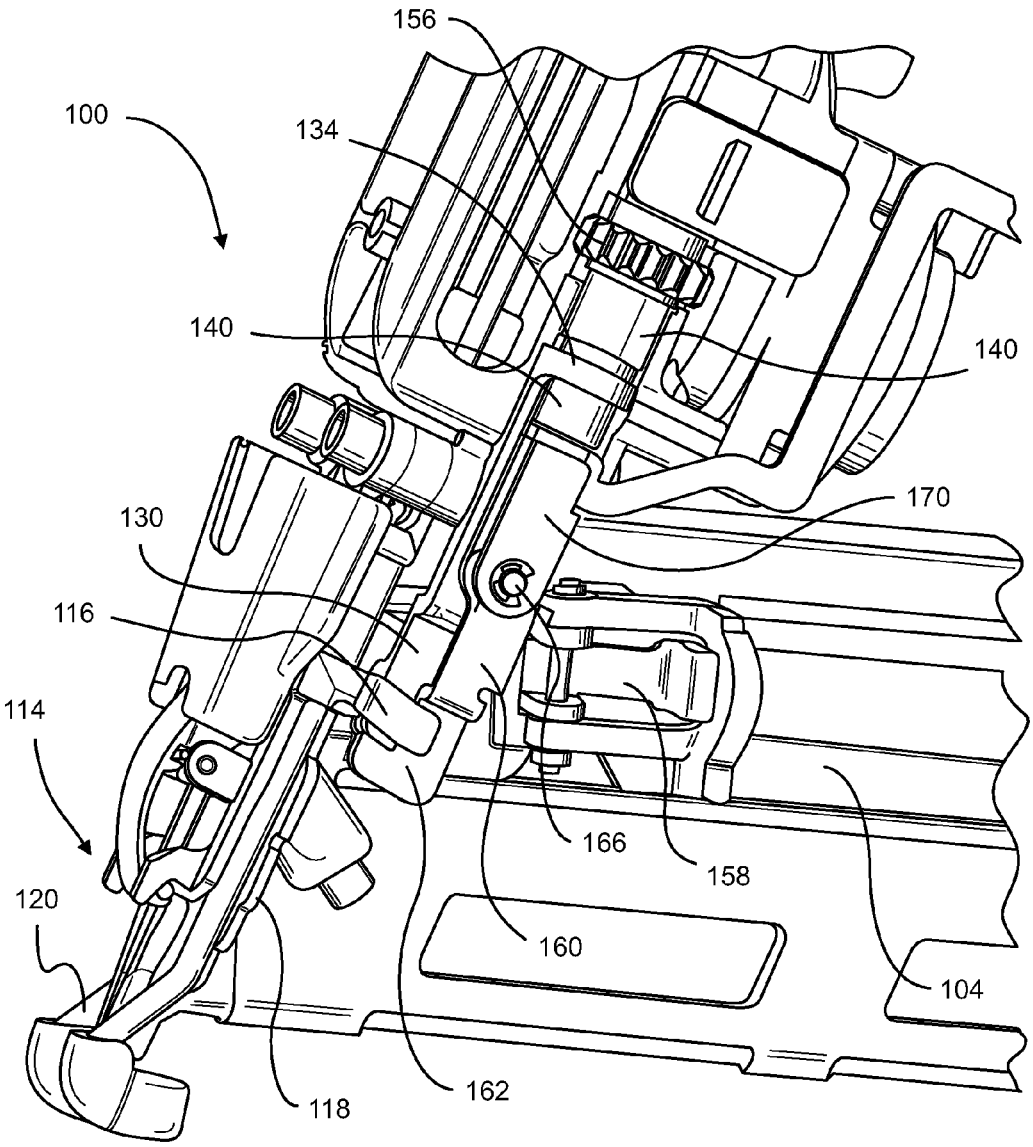
FIG. 2 depicts a cutaway side view of the nose assembly of the fastener driver of FIG. 1 with a work contact element in an extended position and coupled to a blank fire lockout assembly and a depth adjustment mechanism.
Figure 3:
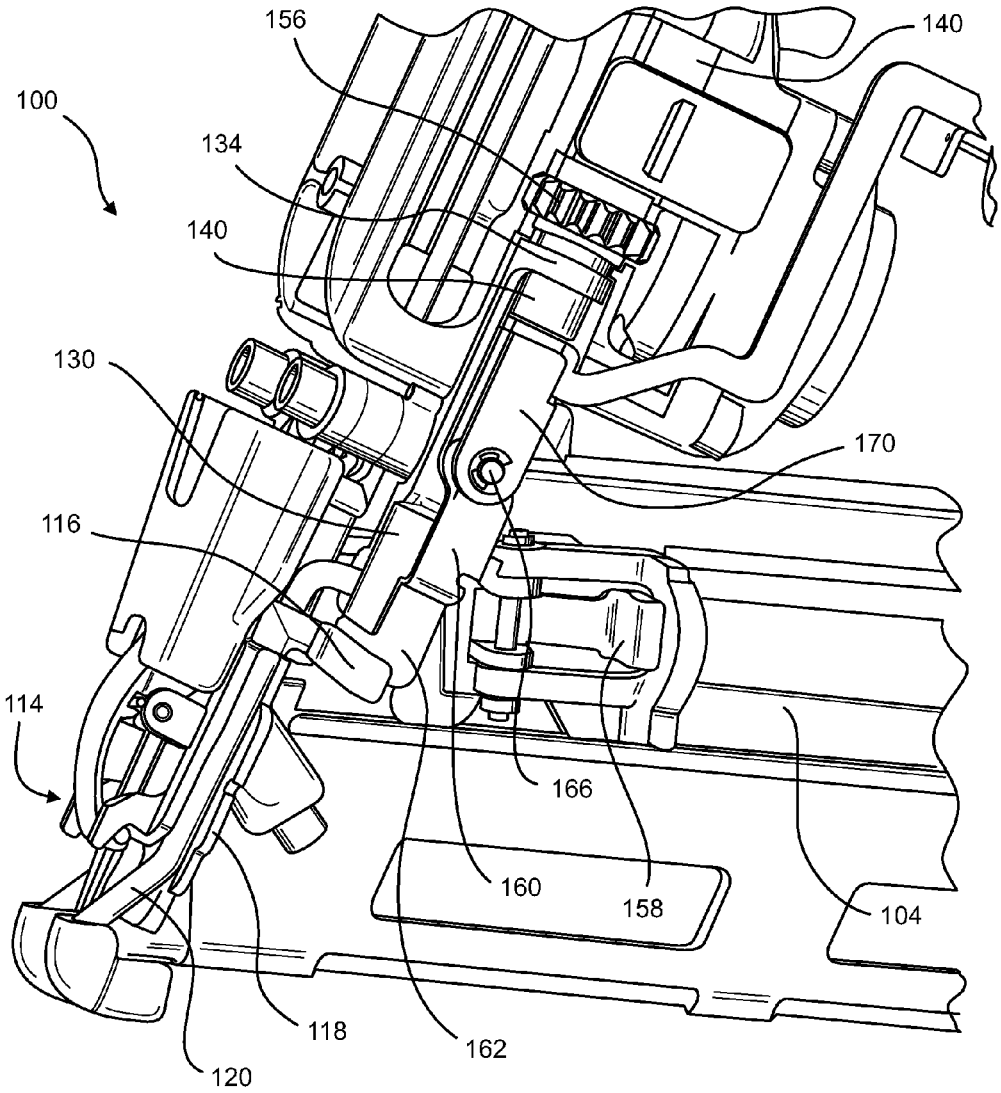
FIG. 3 depicts a cutaway side view of the nose assembly of the fastener driver of FIG. 1 with the work contact element in a depressed/retracted position.

Located adjacent to the drive portion 112 and the magazine 104 is a nose assembly 114. FIG. 2 shows a cutaway view of the nose assembly 114, the lower part of the drive portion 112, and an end portion of the magazine 104. The nose assembly 114 includes a work contact element (WCE) 120 configured to slide along a nose frame 118 which is fixed to the housing 102. The WCE 120 is configured to slide relative to the housing 102 and nose frame 118 between an extended position, as shown in FIG. 2, and a retracted/depressed position, as shown in FIG. 3.

Figure 4:
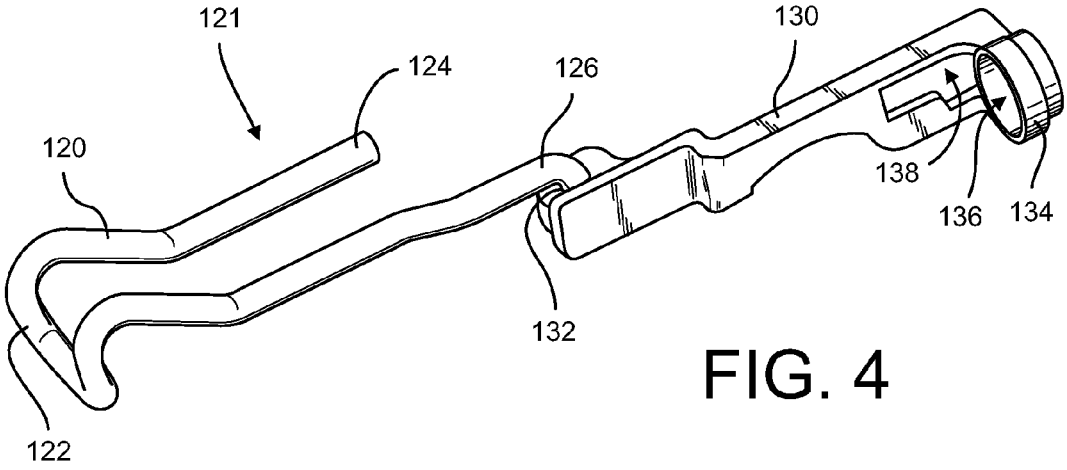
FIG. 4 depicts a perspective view of the work contact element assembly isolated from the other elements of FIG. 2.

As best shown in the isolation view of FIG. 4, the WCE 120 is connected to a WCE arm 130 to form the WCE assembly 121. In this embodiment, the WCE 120 is provided as a wireform bent in a shape such that a blunt contact tip 122 is formed between the two ends 124 and 126 of the wireform. One end 126 of the wireform is inserted in a slot 132 in the WCE arm 130 in order to rigidly connect the WCE 120 to the WCE arm 130.

With continued reference to FIG. 4, the WCE arm 130 includes a circular guide 134 on an end of the arm 130 opposite the slot 132. The circular guide 134 defines a hole 136 and the interior of this hole 136 is threaded. An opening 138 is also formed on the circular guide end of the WCE arm 130.

Figure 5:
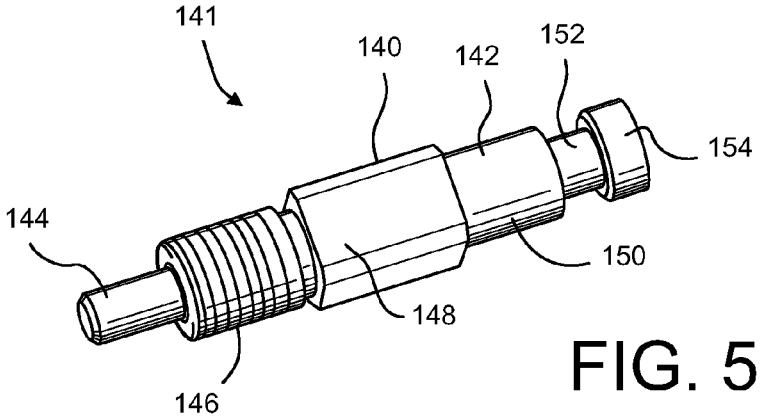
FIG. 5 depicts a perspective view of the depth adjustment mechanism isolated from the other elements of FIG. 2.

With reference now to FIGS. 2 and 5, the WCE assembly 121 is coupled to the depth adjustment mechanism 141. The depth adjustment mechanism 141 comprises a dial 156 (see FIG. 2) connected to a sleeve 140 that is rotatably positioned on a center rod 142. The center rod 142 includes a first cylindrical portion 144 connected to a second cylindrical portion 150. The second cylindrical portion 150 has a greater diameter than the first cylindrical portion 144 such that a shoulder is formed between the first portion 144 and the second portion 150. The center rod 142 also includes a neck 152, and a head 154.

The sleeve 140 is rotatably positioned on the center rod 142 with the first cylindrical portion 144 of the center rod 142 extending completely through the sleeve 140. The sleeve 140 includes a cylindrical threaded segment 146 and a polyhedron segment 148. The dial 156 is slideably mounted on the polyhedron segment 148. The dial 156 is disc shaped with a knurled perimeter. This allows a user to easily rotate the dial 156. Rotation of the dial 156 results in rotation of the sleeve 140 relative to the center rod 142.

The threaded segment 146 of the sleeve 140 is inserted through the circular guide 134 of the WCE arm 130 and threadedly engages the circular hole 136 of the WCE arm 130. Accordingly, rotation of the dial 156 and sleeve 140 results in linear movement of the WCE arm 130 as the threads on the circular guide 134 of the WCE assembly engage the complimentary threads of the threaded segment 146 of the sleeve 140.

Figure 6:
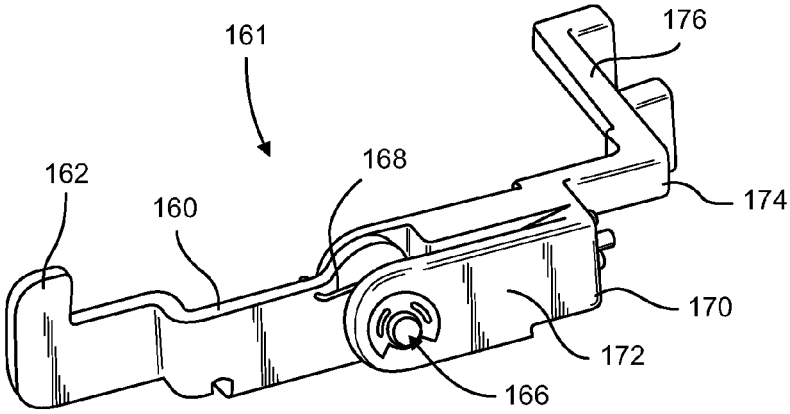
FIG. 6 depicts a perspective view of the blank fire lockout assembly isolated from the other elements of FIG. 2.

With reference now to FIGS. 2 and 6, the depth adjustment mechanism 141 is rotatably coupled to the blank fire lockout assembly 161. As best seen in the isolated view of FIG. 6, the blank fire lockout assembly 161 includes a lower lockout arm 160 that is pivotably connected to a lockout block 170 about a pivot shaft 166. The lockout block 170 includes a body portion 172 with an elbow 174 extending from the body portion 172. The elbow 174 is connected to a lockout finger 176 that extends outward from the body portion. When the device 100 is assembled as shown in FIG. 2, the lockout finger 176 extends through the opening 138 in the WCE assembly 121.

The lockout block 170 also includes a bore (not show) that is configured to receive the end of the first cylindrical portion 144 of the center rod 142. The end of the first cylindrical portion 144 is secured in the bore such that the center rod 142 is fixedly connected to the lockout block 172. The sleeve 140 of the depth adjustment mechanism 141 is rotatably trapped on the center rod 142 between the lockout block 172 and the second cylindrical portion 150 of the center rod 142. In this manner, the sleeve 140 of the depth adjustment mechanism 141 is rotatably coupled to the lockout mechanism 161. Furthermore, because the WCE assembly 121 is coupled to the depth adjustment mechanism 141, the WCE assembly 121 is therefore also coupled to the lockout mechanism 161, as can be seen with reference to FIG. 2.

With continued reference to FIG. 6, the lockout arm 160 is pivotably connected to the lockout block 170 about the pivot shaft 166. Accordingly, one end of the lockout arm 160 includes a hole that allows the pivot shaft 166 to pass through the lockout arm 160. The opposite end of the lockout arm includes a foot 162. As explained in further detail below with reference to FIGS. 7 and 8, this foot 162 provides a surface that blocks the WCE 120 from depressing and thereby prevents the driver from firing.

Figure 7:
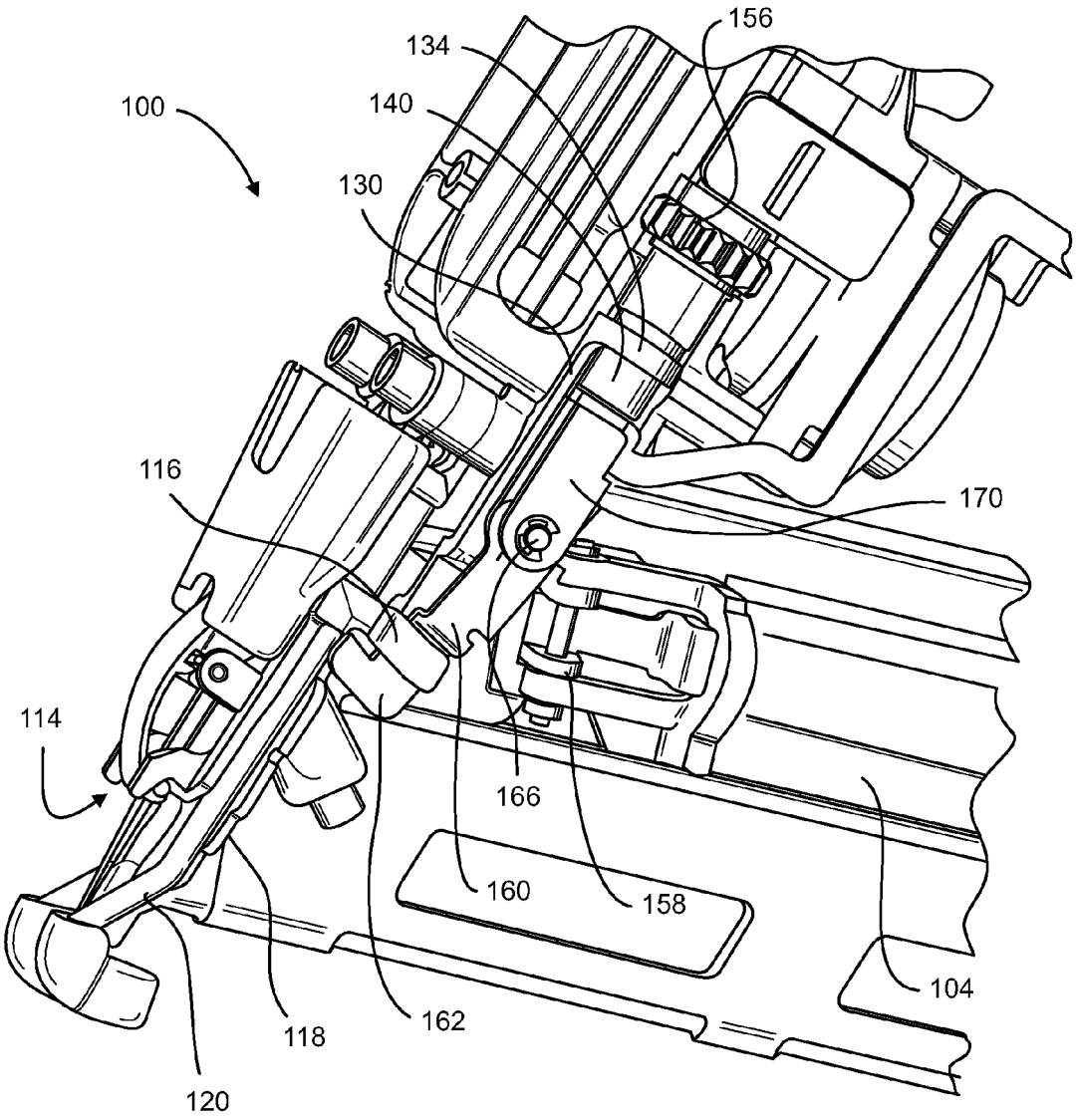
FIG. 7 depicts a cutaway side view of the nose assembly of FIG. 1 with the blank fire lockout assembly in a locked position.
Figure 8:
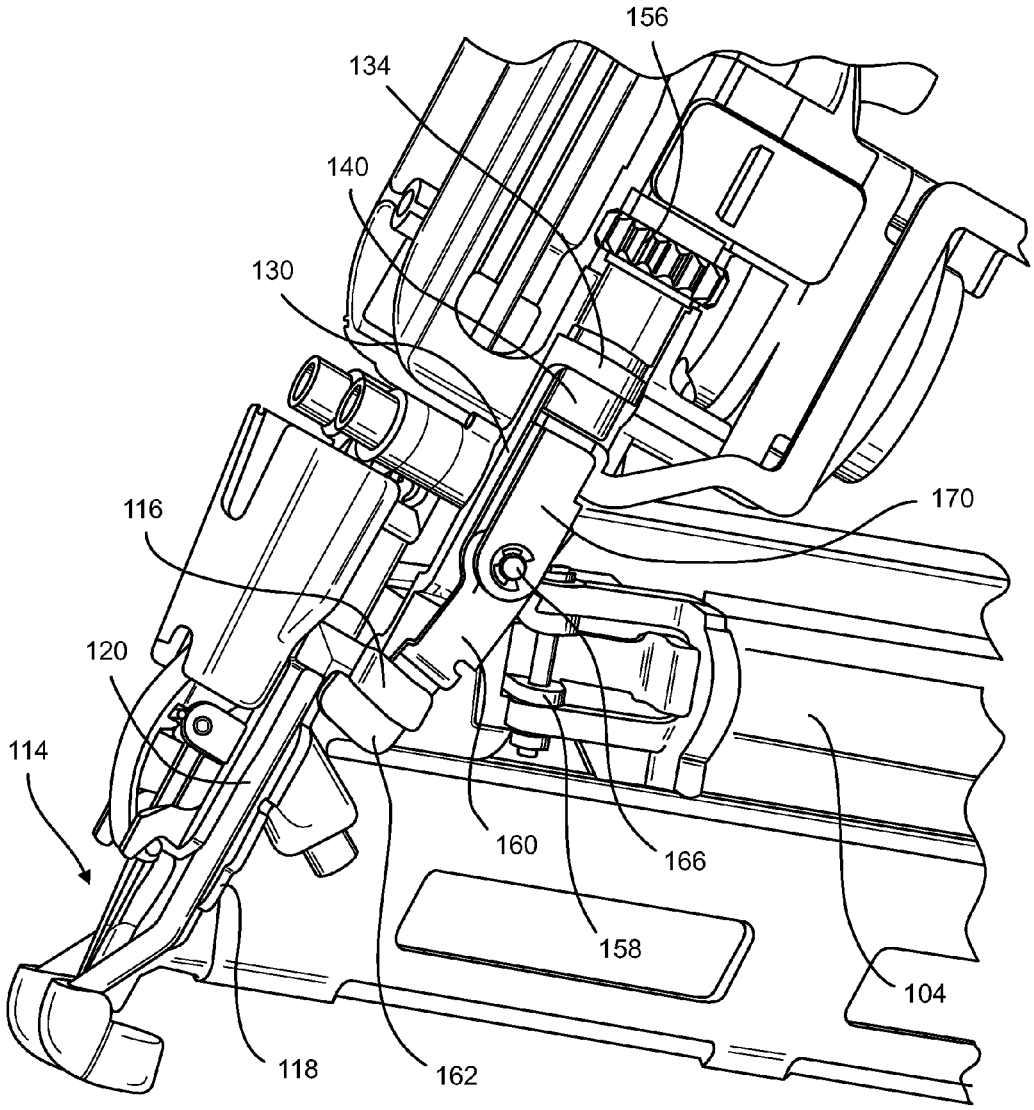
FIG. 8 depicts a cutaway side view of the nose assembly of FIG. 1 with the blank fire lockout assembly engaging a lockout surface fixed to the housing.

The lockout arm 160 is pivotable between a rearward "unlocked" position, as shown in FIGS. 2 and 3, and a forward "locked" position, as shown in FIGS. 7 and 8. A spring 168 is mounted on the pivot shaft 166 and biases the lockout arm 160 toward the unlocked position of FIGS. 2 and 3. A spring loaded follower 158 in the magazine 104 forces fasteners toward the nose 114.

In operation, the WCE assembly 121, blank fire lockout mechanism 161, and depth adjustment mechanism 141 are all coupled together and work as a unit to provide various features for the device 100. FIGS. 2 and 3 generally show operation of these components when the WCE 120 is moved from the extended position to the retracted position. In FIG. 2, the WCE 120 is in an extended position. When the WCE 120 is moved from the extended position shown in FIG. 2 to the retracted position shown in FIG. 3, the WCE arm 130 moves with the WCE 120 and is retracted in a linear direction into the driver housing 102. The WCE arm 130 is coupled to the sleeve 140 of the depth adjustment mechanism and thus, the sleeve 140 is also moved along with the WCE arm 130. When the sleeve 140 is moved in the linear direction, the lockout block 170, pivot shaft 166, and pivot arm 160 of the blank fire lockout mechanism are also moved in the linear direction. Because the pivot arm 160 is in an unlocked position in FIG. 3 the foot 162 of the pivot arm 160 avoids a flange 116 that is positioned in the nose 114 and fixed in relation to the housing 102. In particular, the foot 162 of the pivot arm 160 is allowed to move past the flange 116 as the WCE 120 is moved to the depressed position. When the pivot arm 160 and connected lockout block 170 are allowed to move past the flange, the lockout finger 176 is moved to a position that does not block firing of the device 100, as explained in the following paragraphs with reference to FIGS. 10-12.

Figure 10:
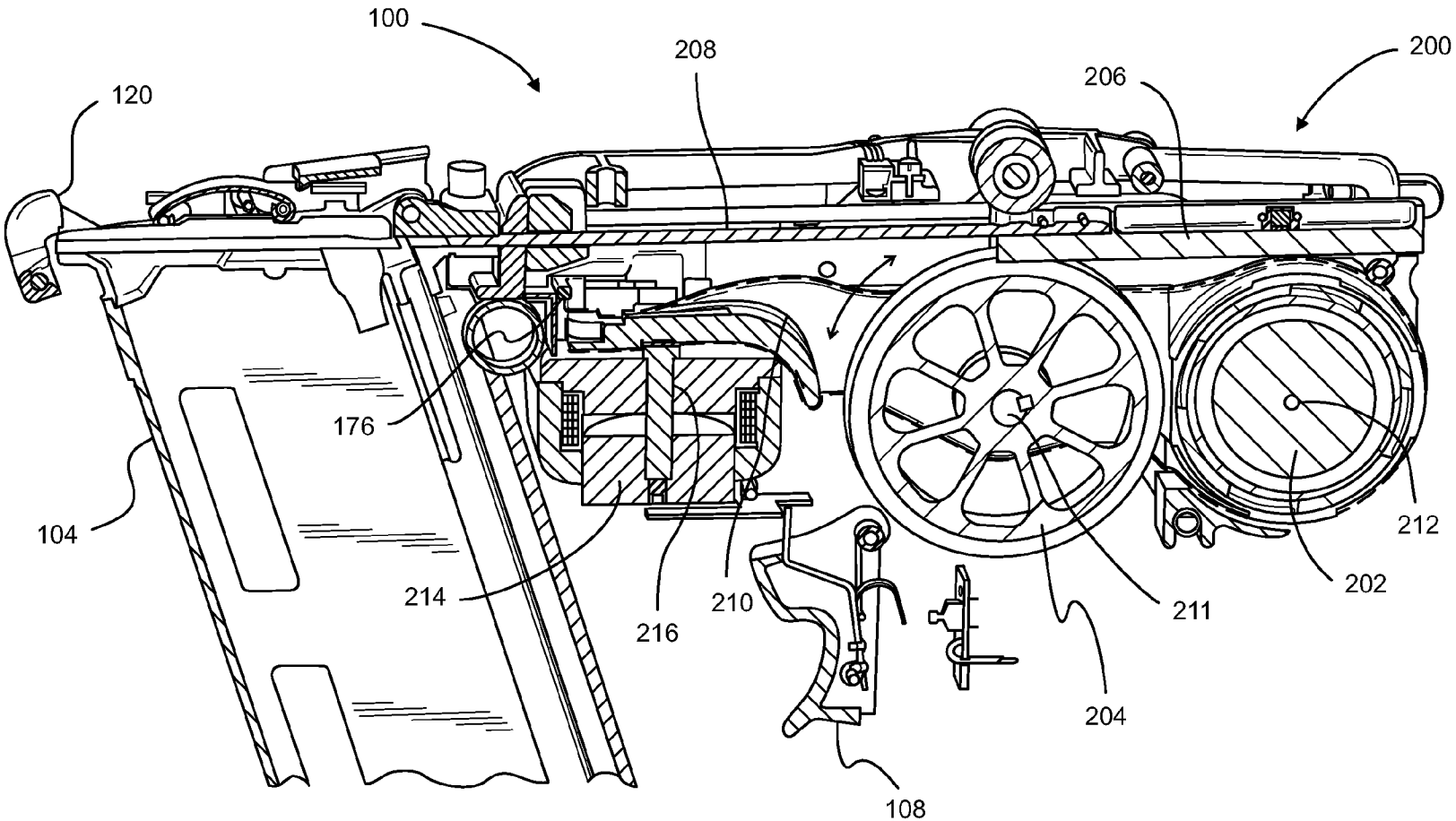
FIG. 10 shows a cutaway opposite side view of the lockout finger of the blank fire lockout assembly of FIG. 6 positioned in the fastener driver and showing the position of the lockout finger in association with a pivoting driver mount.
Figure 11:
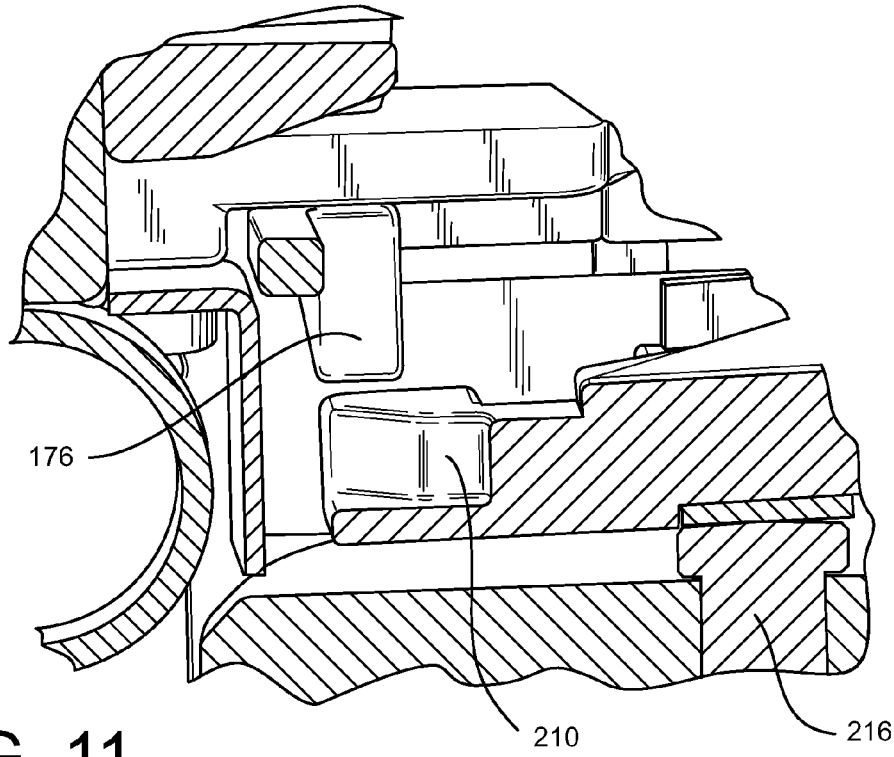
FIG. 11 shows an enlarged view of the lockout finger of FIG. 10 in position to interfere with pivoting of the driver mount.
Figure 12:
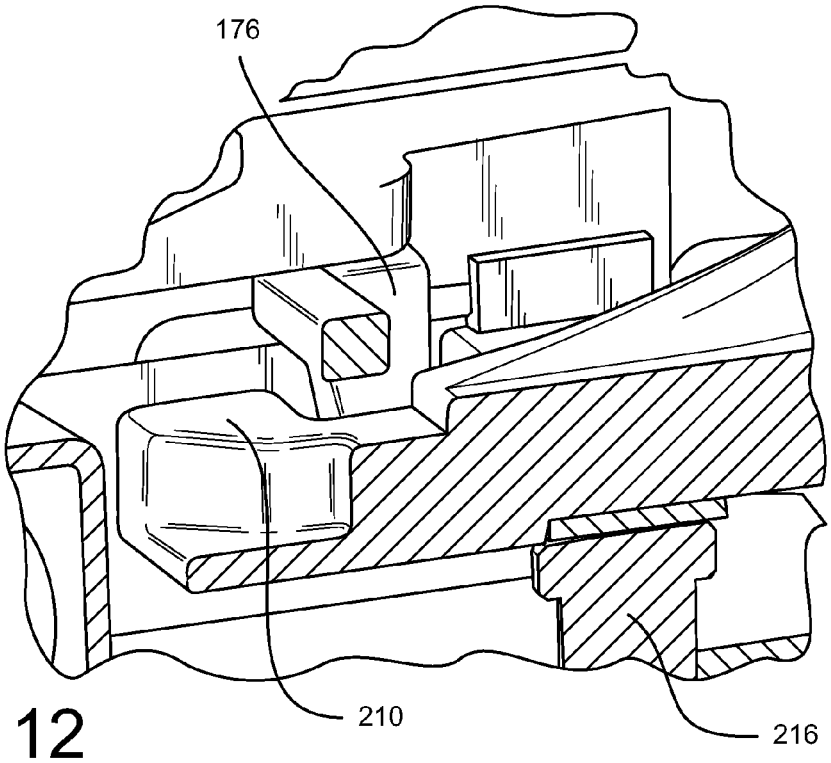
FIG. 12 shows the lockout finger of FIG. 11 moved to a position where the driver mount can pivot.

FIGS. 10-12 show an opposite side view of the device 100 in order to show movement of the lockout finger 176 when the WCE 120 is moved from the extended position of FIG. 2 to the depressed position of FIG. 3. As shown in FIG. 10, the device 100 includes a drive assembly 200 including a DC motor 202, a flywheel 204, a drive block 206, a drive blade 208. The flywheel 204 is positioned on a pivotable mount 210 (highlighted with dotted lines in FIG. 10) and is configured to rotate about pivot axis 211. The mount 210, in turn, is configured to pivot about a pivot point 212.

When a user pulls the trigger 108, the DC motor 202 is energized and transmits power to the flywheel 204 via a drive belt. Once a predetermined flywheel speed has been reached, a solenoid 214 is energized, causing a plunger 216 to move into contact with the mount 210. The plunger 216 forces the mount 210 and rotating flywheel 204 to pivot toward the drive block 206. When the rotating flywheel 204 comes into contact with the drive block 206, the drive block 206 and connected drive blade 208 are propelled toward the nose. When the drive block 206 and blade 208 are fired, drive blade 208 impacts the fastener positioned at the end of the magazine 104 and expels the fastener from the device 100. A similar arrangement is disclosed in U.S. patent application Ser. No. 12/191,960, the contents of which are incorporated herein in their entirety. Furthermore, although the drive assembly of FIG. 10 includes a DC motor and flywheel, it will be recognized that any of various other drive assemblies are possible.

With particular reference now to FIG. 11, when the WCE 120 is in the extended position, the connected lockout finger 176 is positioned in the pivot path of the mount 210 and blocks the mount 210 from pivoting toward the drive block 206. However, as shown in FIG. 12, when the WCE 120 is in the depressed position, the connected lockout finger 176 is moved out of the way of the mount 210, allowing the mount to pivot toward the drive block 206 and fire the device.

With reference now to FIGS. 7 and 8, the blank fire lockout assembly 161 is shown with the pivot arm 160 moved to the locked position. The pivot arm 160 is moved to this position when the magazine 104 reaches a low level of fasteners, such as only one or two fasteners or no fasteners, depending on the size of the fasteners and predetermined device configurations. In particular, as each fastener is expelled from the magazine 104, the spring driven follower 158 moves closer to the pivot arm 160. When the magazine 104 reaches a low level of fasteners, the follower 158 contacts the pivot arm 160. Subsequent movement of the follower 158 forces the pivot arm 160 to pivot about the shaft 166 and forces the pivot arm toward the locked position of FIG. 7. Because the follower 158 contacts the pivot arm 160 near the pivot shaft 166, and mechanical advantage is realized as the foot end of the pivot arm travels a greater distance than the follower 158, allowing the foot end of the pivot arm 160 to quickly reach the locked position.

As shown in FIG. 8, if a user attempts to depress the WCE 120 and operate the device 100 with the pivot arm 160 in the locked position, the foot 162 of the pivot arm contacts the stationary flange 116 in the nose 114 of the device, preventing the pivot arm 160 from being depressed further into the housing. Because the WCE 120 is coupled to the pivot arm 160, this also prevents the WCE 120 from being depressed into the housing, and prevents the device from firing. Thus, the pivoting arm 160 of the blank fire lockout mechanism prevents the device 100 from firing when the magazine is low on fasteners, and prevents possible damage to the device that may occur as a result of a blank fire. The blank fire lockout mechanism also warns the user that the magazine should be refilled with fasteners before continuing work.

Figure 9A:
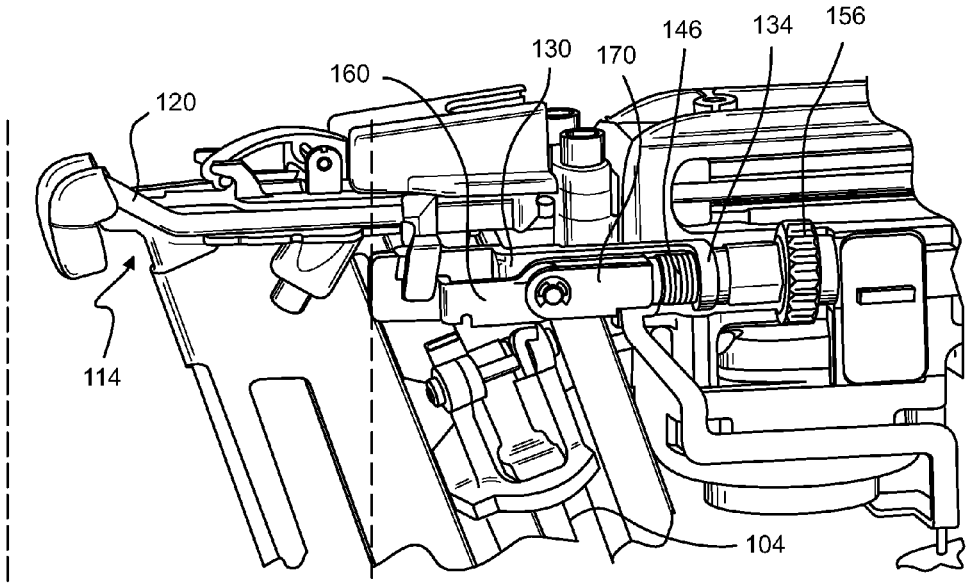
FIG. 9A depicts a cutaway side view of the nose assembly of FIG. 1 with the depth adjustment mechanism retaining the work contact element in a first depth position.
Figure 9B:
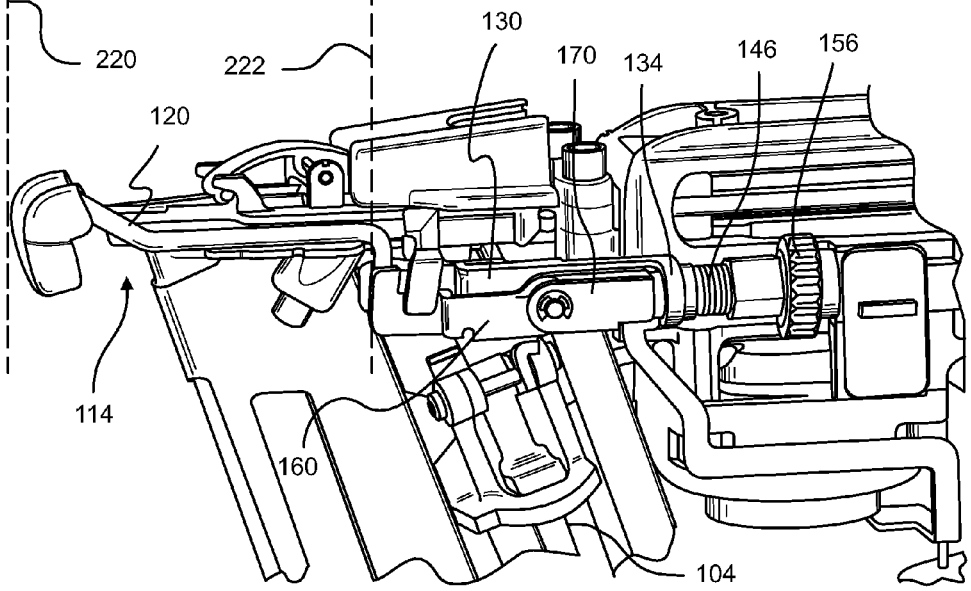
FIG. 9B depicts a cutaway side view of the nose assembly of FIG. 1 with the depth adjustment mechanism retaining the work contact element in a second depth position.

With reference now to FIGS. 9A and 9B, operation of the depth adjustment mechanism is shown. In both FIGS. 9A and 9B, the WCE 120 is shown in the extended position. However, in FIG. 9B, the WCE 120 is extended further than in FIG. 9A. Two dotted lines 220 and 222 extend between FIGS. 9A and 9B to show this adjusted position of the WCE 120 in the two figures. The device 100 will drive a fastener further in a work piece when the WCE 120 is at the depth shown in FIG. 9A than when the WCE 120 is at the depth shown in FIG. 9B.

In order for a user to adjust the position of the WCE 120 from that shown in FIG. 9A to that of FIG. 9B, or vice-versa, the user simply rotates the dial 156 with his or her hand. When the dial 156 is rotated, the threads on the circular guide 134 of the WCE arm 130 engage the threads on the threaded segment 146 of the sleeve 140 to move the WCE arm 130 along the threaded segment 146. At the same time, the WCE 120 connected to the WCE arm 130 moves in a linear direction, as noted by dotted line 220. However, as shown by dotted line 222, when the WCE 120 moves in the linear direction by rotation of the dial 156, the pivot arm 160 and connected lockout block 170 of the blank fire lockout mechanism do not move. Therefore, when the pivot arm 160 is in the locked position, the WCE must only be depressed the same small distance before the tool locks out, regardless of the depth adjustment setting. Similarly, when the pivot arm is in the unlocked position, the WCE 120 must be depressed the same distance before the device 100 can be fired, regardless of the depth adjustment setting. Accordingly, this arrangement provides for a robust design that gives constant feedback to the user, regardless of the depth adjustment setting.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. A device for driving a fastener comprising:

a housing;

a magazine configured to retain a plurality of fasteners;

a driver assembly configured to provide an expulsion force that expels one of the plurality of fasteners from the magazine;

a rotatable depth adjustment mechanism configured to rotate about an axis defining an axis of rotation aligned along a linear direction;

a lockout arm coupled to the rotatable depth adjustment mechanism and configured to pivot about a pivot axis between an unlocked position and a lockout position, the pivot axis configured to move in the linear direction and relative to the housing from a first position to a second position, wherein the driver assembly is prevented from providing the expulsion force when the lockout arm is in the lockout position; and a work contact element coupled to the rotatable depth adjustment mechanism and coupled to the lockout arm, the work contact element moveable in the linear direction between an extended position and in the linear direction toward the housing to a depressed position, wherein the driver assembly is prevented from delivering the expulsion force when the work contact element is in the extended position, and wherein the pivot axis is located at the first position when the work contact element is in the extended position and movement of the work contact element from the extended position to the depressed position results in movement of the pivot axis in the linear direction from the first position to the second position.

2. The device of claim 1 further comprising a blocking surface fixed relative to the housing and the lockout arm includes a contact surface wherein the work contact element is blocked from moving from the extended position to the depressed position when the lockout arm is in the lockout position and the contact surface contacts the blocking surface.

3. A device for driving a fastener comprising:

a housing;

a blocking surface fixed relative to the housing;

a magazine configured to retain a plurality of fasteners;

a driver assembly configured to provide an expulsion force that expels one of the plurality of fasteners from the magazine;

a lockout arm including a contact surface and configured to pivot about a pivot axis between an unlocked position and a lockout position, wherein the driver assembly is prevented from providing the expulsion force when the lockout arm is in the lockout position; and a work contact element coupled to the lockout arm, the work contact element moveable in a linear direction between an extended position and a depressed position, wherein the driver assembly is prevented from delivering the expulsion force when the work contact element is in the extended position, wherein the pivot axis is located at the first position when the work contact element is in the extended position and movement of the work contact element from the extended position to the depressed position results in movement of the pivot axis in the linear direction from the first position to the second position and wherein the pivot axis is prevented from moving in the linear direction and the work contact element is blocked from moving from the extended position to the depressed position when the lockout arm is in the lockout position and the contact surface of the lockout arm engages the blocking surface.

4. The device of claim 1 wherein the magazine includes a follower and the lockout arm is configured to move responsively to contact with the follower from the unlocked position to the locked position when less than a predetermined number of fasteners remain in the magazine.

5. The device of claim 1 wherein the driver assembly comprises a drive block and a power device configured to propel the drive block toward one of the fasteners in the magazine and provide the expulsion force.

6. A device for driving a fastener comprising:

a housing;

a magazine configured to retain a plurality of fasteners;

a driver assembly configured to expel one of the plurality of fasteners from the magazine;

a blocking surface fixed relative to the housing;

a work contact element configured to move between a first position and a second position, wherein the driver assembly is allowed to expel fasteners when the work contact element is in the second position and prevented from expelling fasteners when the work contact element is in the first position; and a lockout mechanism including a contact surface fixedly coupled to the work contact element and configured to move responsively and simultaneously with movement of the work contact element and in substantially the same direction as the direction of movement of the work contact element when the work contact element is moved between the first position and the second position, the lockout mechanism configured to move from an unlocked position to a locked position, wherein the work contact element is blocked from moving to the second position when the lockout mechanism is in the locked position and the contact surface contacts the blocking surface.

7. The device of claim 6 wherein the lockout mechanism is configured to move from the unlocked position to the locked position based on the number of fasteners retained in the magazine.

8. The device of claim 6 wherein the lockout mechanism includes a pivot arm configured to move between the locked position and the unlocked position.

9. The device of claim 8 wherein the magazine includes a follower and the pivot arm is spring biased toward the unlocked position and is forced toward the locked position by contact with the follower of the magazine when the number of fasteners in the magazine reaches less than a predetermined number of fasteners.

10. A device for driving a fastener comprising:

a magazine configured to retain a plurality of fasteners;

a driver assembly configured to expel one of the plurality of fasteners from the magazine;

a work contact element configured to move between a first position and a second position, wherein the driver assembly is allowed to expel fasteners when the work contact element is in the second position and prevented from expelling fasteners when the work contact element is in the first position; and a lockout mechanism coupled to the work contact element and configured to move responsively with movement of the work contact element and in substantially the same direction as the direction of movement of the work contact element when the work contact element is moved between the first position and the second position, the lockout mechanism configured to move from an unlocked position to a locked position, wherein the work contact element is blocked from moving to the second position when the lockout mechanism is in the locked position wherein the lockout mechanism includes a pivot arm configured to move between the locked position and the unlocked position and wherein the pivot arm includes a surface configured to engage a flange fixedly connected to a housing of the device for driving a fastener when the pivot arm is in the locked position and the work contact element is moved from the first position toward the second position.

11. The device of claim 6 further comprising a rotatable depth adjustment mechanism, wherein rotation of the depth adjustment mechanism adjusts the extended position of the work contact element, and wherein the work contact element and the lockout mechanism are both coupled to the rotatable depth adjustment mechanism.

12. The device of claim 11 wherein the work contact element threadedly engages a shaft of the depth adjustment mechanism such that rotation of the shaft results in linear movement of the work contact element, and wherein the shaft is rotatably coupled to the lockout mechanism such that the shaft is rotatable with respect to the lockout mechanism.

13. A device for driving a fastener comprising:

a nose configured to pass a fastener;

a work contact element extending from the nose;

a depth adjustment mechanism coupled to the work contact element, the depth adjustment mechanism defining a rotational axis aligned along a linear direction and about which the depth adjustment mechanism rotates, wherein the work contact element is moveable in the linear direction and rotational movement of the depth adjustment mechanism about the rotational axis is parallel or approximately parallel to the linear direction of the work contact element and results in linear movement of the work contact element in the extended position; and a lockout mechanism coupled to the depth adjustment mechanism, the lockout mechanism moveable between an unlocked position and a locked position, wherein the lockout mechanism is configured to prevent movement of the work contact element from the extended position to the retracted position when the lockout mechanism is in the locked position and wherein the lockout mechanism is configured to move in the linear direction when the work contact element is moved from the extended position to the retracted position.

14. The device of claim 13 wherein the lockout mechanism includes a pivot arm.

15. The device of claim 3 wherein the magazine includes a follower and the lockout arm is configured to move responsively to contact with the follower from the unlocked position to the locked position when less than a predetermined number of fasteners remain in the magazine.

16. The device of claim 3 wherein the driver assembly comprises a drive block and a power device configured to propel the drive block toward one of the fasteners in the magazine and provide the expulsion force.

17. The device of claim 10 further comprising a rotatable depth adjustment mechanism, wherein rotation of the depth adjustment mechanism adjusts the extended position of the work contact element, and wherein the work contact element and the lockout mechanism are both coupled to the rotatable depth adjustment mechanism.

18. The device of claim 17 wherein the work contact element threadedly engages a shaft of the depth adjustment mechanism such that rotation of the shaft results in linear movement of the work contact element, and wherein the shaft is rotatably coupled to the lockout mechanism such that the shaft is rotatable with respect to the lockout mechanism.

* * * * *